US006098697A

United States Patent [19]

Krupke et al.

[11] Patent Number: 6,098,697

[45] Date of Patent: Aug. 8, 2000

[54] SECTIONAL DOOR WITH PINCH RESISTANT HINGE BETWEEN DOOR SECTIONS

[75] Inventors: LeRoy G. Krupke, Carrollton; D. Scott Boucher, Rowlett; W. Mark Megarity, Irving, all of Tex.

[73] Assignee: Overhead Door Corporation, Dallas, Tex.

[21] Appl. No.: 09/096,842

[22] Filed: Jun. 12, 1998

[51] Int. Cl.[7] ..... E05D 15/10

[52] U.S. Cl. ..... 160/229.1; 160/232

[58] Field of Search ..... 160/229.1, 201, 160/40, 232, 235, 199, 206, 207

[56] References Cited

U.S. PATENT DOCUMENTS

| | | | |
|---|---|---|---|
| 2,391,845 | 12/1945 | Rowe | 160/201 |
| 2,525,309 | 10/1950 | Norberg | 160/201 X |
| 2,557,716 | 6/1951 | Allee | 16/137 |
| 2,641,018 | 6/1953 | Snyder | 16/178 |
| 2,880,796 | 4/1959 | Stroup | 160/232 |
| 3,359,594 | 12/1967 | Pastoor | 16/178 |
| 3,376,913 | 4/1968 | Clapsaddle | 160/201 |
| 3,891,021 | 6/1975 | Geoffrey | 160/201 X |
| 3,941,180 | 3/1976 | Thill | 160/229 |
| 4,532,973 | 8/1985 | DeFalco | 160/235 |
| 4,771,816 | 9/1988 | Clay, Jr. | 160/135 |
| 4,893,666 | 1/1990 | Hormann | 160/229 |
| 4,924,932 | 5/1990 | Esnault | 160/201 |
| 5,002,114 | 3/1991 | Hormann | 160/229 |
| 5,133,108 | 7/1992 | Esnault | 16/225 |
| 5,148,850 | 9/1992 | Urbanick | 160/231.1 |
| 5,170,832 | 12/1992 | Wagner | 160/201 |
| 5,404,927 | 4/1995 | Bailey | 160/201 |
| 5,435,108 | 7/1995 | Overholt et al. | 52/309.11 |
| 5,509,457 | 4/1996 | Jella | 160/201 |
| 5,553,651 | 9/1996 | Olsen | 160/235 |
| 5,562,141 | 10/1996 | Mullet et al. | 160/232 |
| 5,564,164 | 10/1996 | Jella | 16/355 |
| 5,622,012 | 4/1997 | Schijf | 160/235 X |
| 5,626,176 | 5/1997 | Lewis, Jr. et al. | 160/201 |
| 5,669,431 | 9/1997 | Druzynski et al. | 160/229.1 |
| 5,782,283 | 7/1998 | Kendall | 160/229 |
| 5,857,510 | 1/1999 | Krupke et al. | 160/201 |

FOREIGN PATENT DOCUMENTS

| | | |
|---|---|---|
| 0623724 A1 | 9/1994 | European Pat. Off. . |
| 1310605 | 10/1961 | France . |
| 3922981 A1 | 5/1990 | Germany . |

*Primary Examiner*—David M. Purol

*Attorney, Agent, or Firm*—Akin, Gump, Strauss, Hauer, & Feld, L.L.P.

[57] ABSTRACT

A sectional upward acting door including plural door sections interconnected by hinges and supporting guide members on opposite side edges of each section for moving the door between open and closed positions along spaced apart guide tracks. The door sections are formed from folded metal panels defining an outer wall of each section, opposed top and bottom walls which are curved to provide a pinch resistant connection between door sections and upper and lower inner walls. The upper inner wall includes a socket for receiving a hinge assembly including an elongated hinge plate which is snap fitted into assembly with plural self-lubricating polymer hinge bearing members which fit within the socket. Spaced apart end stiles and center or intermediate stiles support the panel member and transfer the weight of the door sections and other loads between sections at the hinge bearing members. The bottom and top wall profiles of adjacent sections and the hinge assembly provide a substantially pinch resistant door assembly.

28 Claims, 11 Drawing Sheets

SECTIONAL DOOR WITH PINCH RESISTANT HINGE BETWEEN DOOR SECTIONS

FIELD OF THE INVENTION

The present invention pertains to an upward acting sectional door, such as a garage door, which includes a pinch resistant edge profile between adjacent door sections, an improved hinge construction and improved door panel construction.

BACKGROUND

In the continued development of sectional doors, particularly upward acting sectional doors used for residential and commercial building garages, there has been a need to develop door sections which have cooperating edges forming a substantially pinch resistant connection between the door sections. Several attempts have been made to develop a suitable edge profile between cooperating door sections to provide resistance to insertion of a person's fingers, commonly referred to as a pinchproof or pinch resistant profile. Several somewhat complicated edge profiles have been developed in an effort to provide pinch resistance from both sides of the door. However, some of the more complicated edge profiles do not lend themselves suitably to the fabrication of the door sections from rolled metal sheets or panels, which fabrication method is efficient, cost effective and thus quite popular for the fabrication of residential garage doors, in particular.

Another problem associated with the fabrication of upward acting sectional doors pertains to providing adequate door section strength and load transfer capability between sections when the door is in the closed position while at the same time providing a door which may be fabricated of various materials, including, in particular, relatively thin or lightweight metal sheet. This problem has been aggravated somewhat by prior art efforts to develop suitable pinch resistant door edge profiles and hinge combinations.

It is with a view to overcoming the problems associated with the development of lightweight, low cost sectional doors which have superior strength and superior pinch resistant capability that the present invention has been developed.

SUMMARY OF THE INVENTION

The present invention provides an improved sectional door, particularly adapted as an upward acting garage door and the like and having a pinch resistant edge profile between adjacent door sections.

The present invention also provides a sectional door made up of multiple panels which are preferably formed of a thin sheet or skin which may be fabricated by metal rolling techniques and adapted to include a unique hinge construction which aids in providing suitable door strength and a pinch resistant capability of the door from both sides of the door.

The present invention still further provides an improved sectional door made up of interconnected door sections each comprising a relatively thin sheet-like skin which may be folded or extruded to provide the requisite door section shape, including pinch resistant profile edges. The improved door sections are each reinforced by improved center or intermediate stile and end stile constructions, respectively, and may be easily fabricated.

In accordance with yet another aspect of the present invention, a sectional door is provided which includes improved mounting structure for door side edge guide devices, such as guide rollers. Still further, the door of the present invention may be advantageously manufactured to be uninsulated, partially insulated or fully insulated in accordance with improved door panel construction.

Those skilled in the art will further appreciate the above-mentioned advantages and features of the invention upon reading the detailed description which follows in conjunction with the drawings.

DETAILED DESCRIPTION OF PREFERRED EMBODIMENTS

Figure 1:
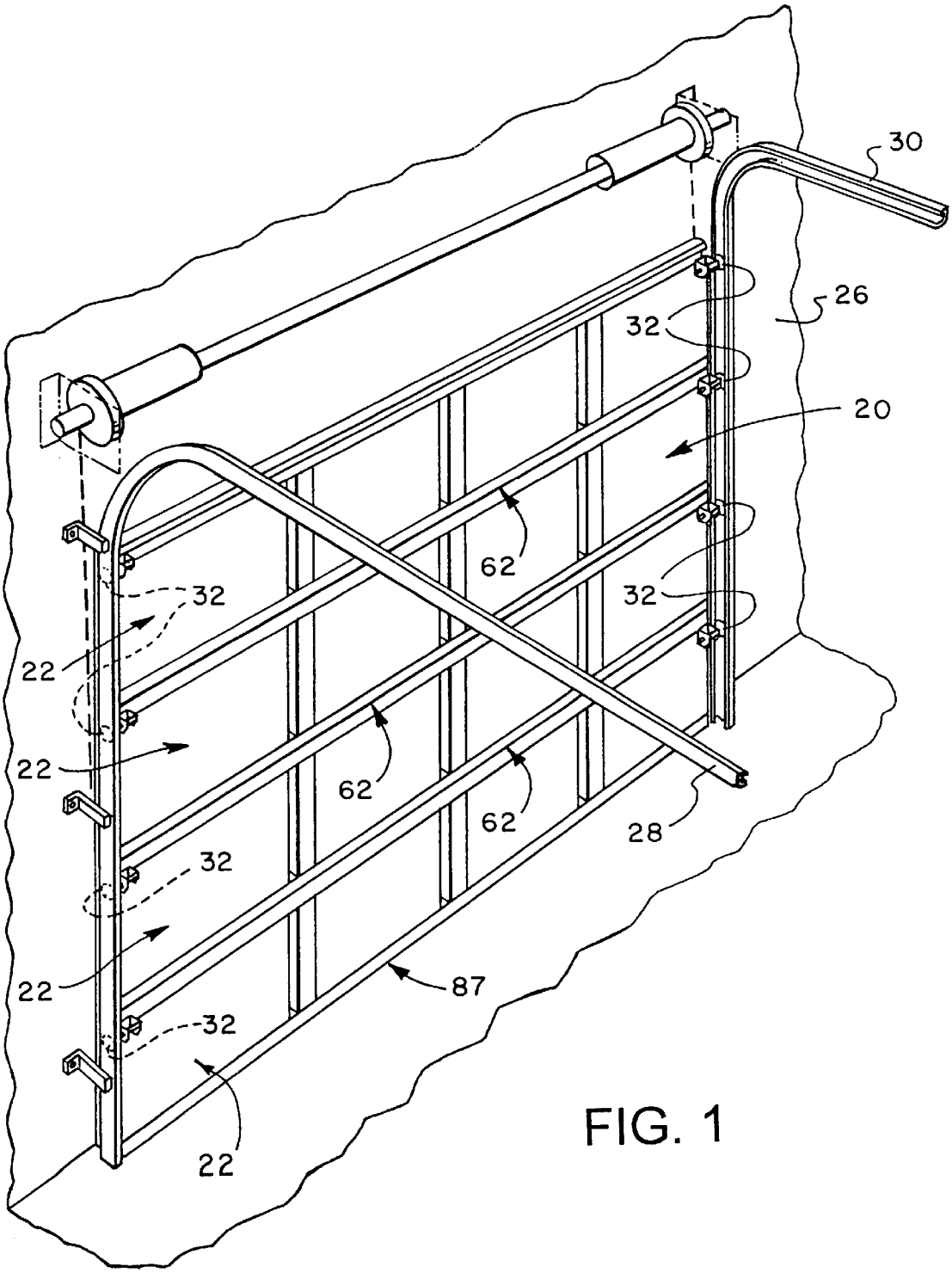
FIG. 1 is a perspective view, taken from the inside of a building, having an opening in which a sectional door in accordance with the invention is disposed to cover the opening.

In the description which follows, like elements are marked throughout the specification and drawing with the same reference numerals, respectively. The drawing figures are not necessarily to scale and certain features of the invention may be shown exaggerated in scale or in somewhat schematic or generalized form in the interest of clarity and conciseness.

Referring to FIG. 1, there is illustrated an upward acting sectional door in accordance with the invention and generally designated by the numeral 20. The door 20 may be fabricated in various lengths and widths, typically between 8 feet to 20 feet wide and 7 to 9 feet in height. The door 20 is typically made up of from four to six interconnected, generally rectangular planar door sections 22 which are interconnected to each other and fabricated in accordance with the invention and as further described hereinbelow. The door 20 is adapted to form a closure over a generally rectangular opening, not shown, formed in a vertical wall 26 of a building, such as a residential garage.

The door 20 is adapted to be moved between the closed position shown in FIG. 1 and an open position by suitable mechanism, not shown, and supported in both the closed and open positions as well as all intermediate positions by opposed, generally channel shaped, guide tracks 28 and 30. The tracks 28 and 30 may be of conventional construction and suitably supported on the wall 26 as well as by a ceiling, not shown, of the aforementioned garage. Each of the sections 22 is provided with opposed guide members 32 including portions which are disposed within the channel shaped guide tracks 28 and 30 for guiding and supporting the door 20 in its closed position, its open position and all intermediate positions. The lowermost section 22 may require two spaced apart sets of guide members 32, as shown. The guide members 32 and their support structure will be described in further detail herein.

Figure 2:
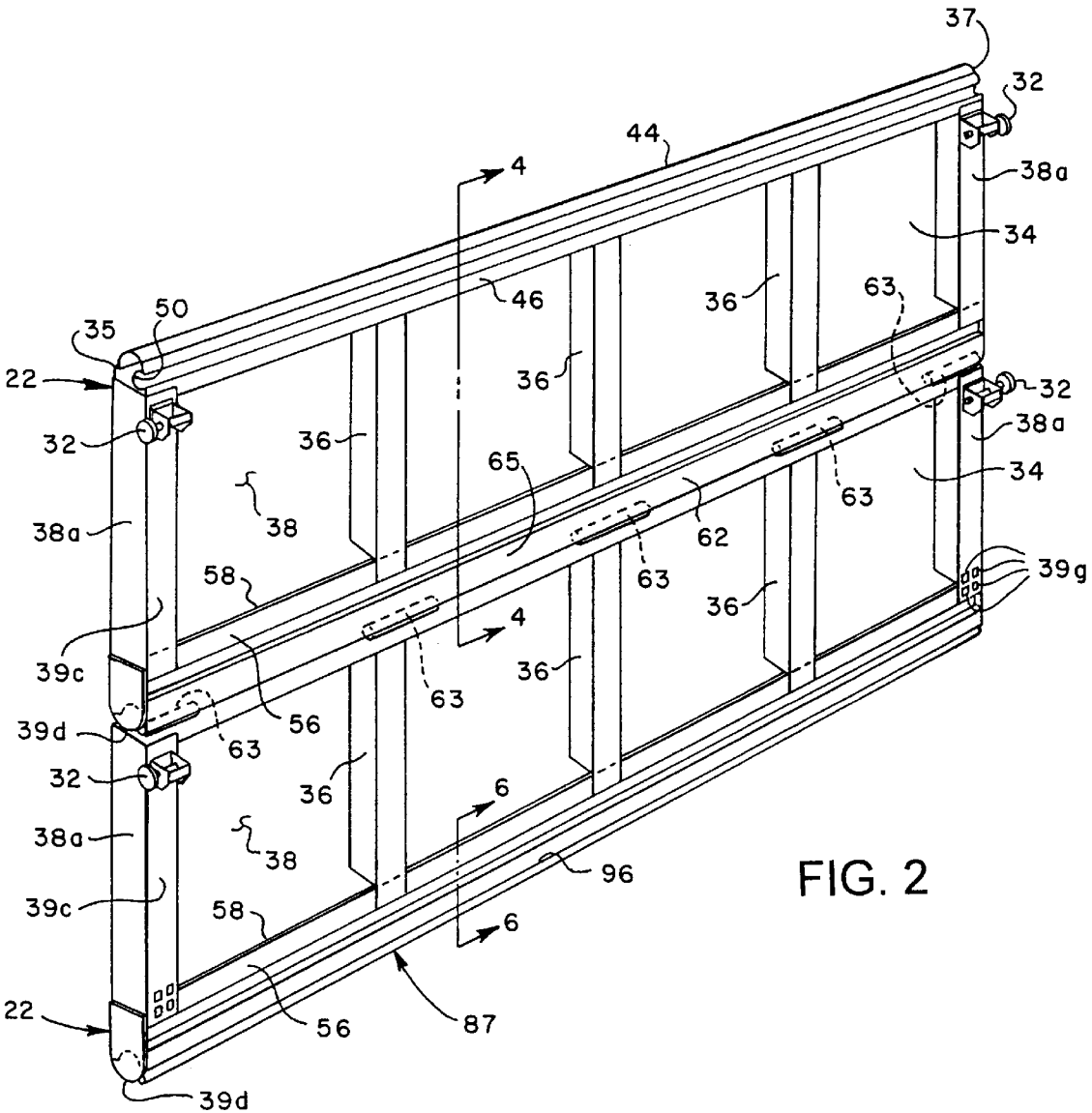
FIG. 2 is a perspective view on a larger scale showing two adjacent panels of the door shown in FIG. 1 and illustrating further details of the door panel reinforcing structure.

Referring now to FIG. 2, there is illustrated, on a larger scale, further details of the two lowermost sections 22 of the door 20 for purposes of illustrating the structural details of the sections and the pinch resistant hinge connection between each section. Each section 22 of the door 20 is characterized by a generally planar, rectangular panel 34 which is preferably formed of rolled or folded metal sheet, mild steel of about 0.018 inches thickness, for example. The panel 34 is reinforced by vertically extending intermediate reinforcing members or stiles 36 and opposed end stiles 38*a*.

Figure 4:
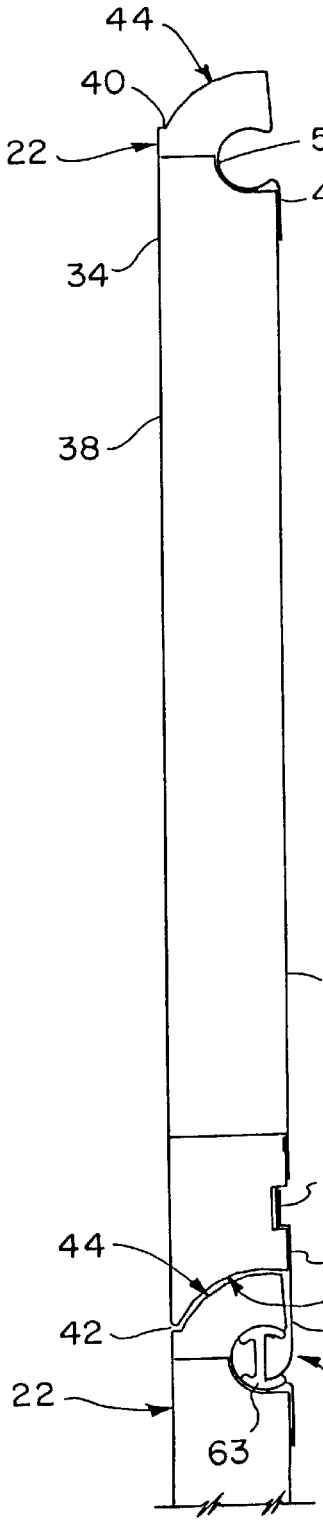
FIG. 4 is a section view taken from the line 4—4 of FIG. 2.
Figure 4A:
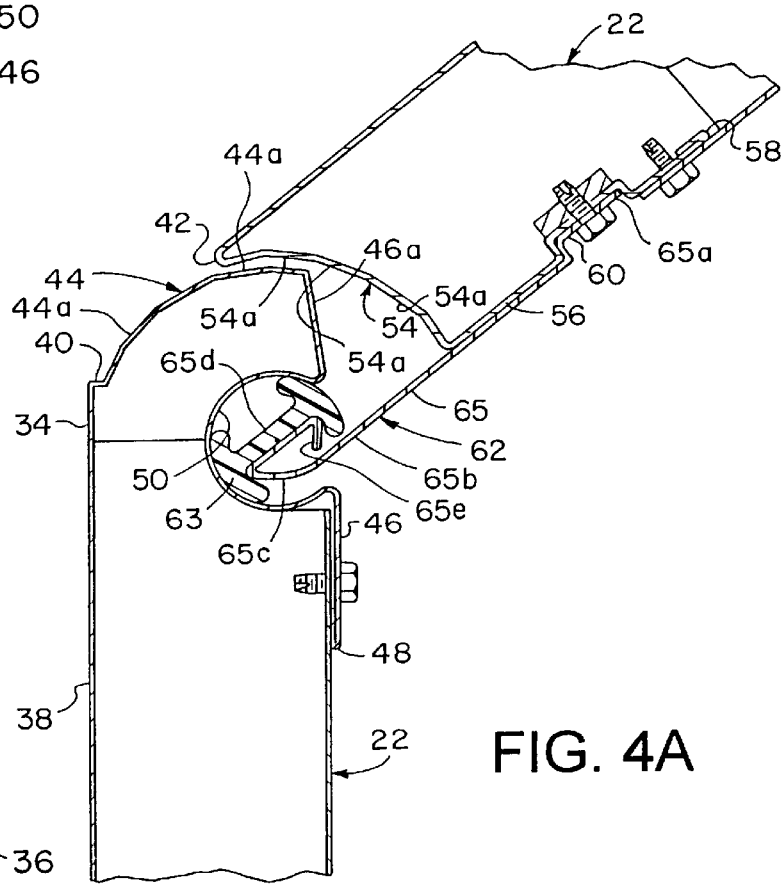
FIG. 4A is a detail section view taken from the same line as FIG. 4, on a larger scale and showing details of the pinch resistant edge profile and hinge construction.
Figure 5:
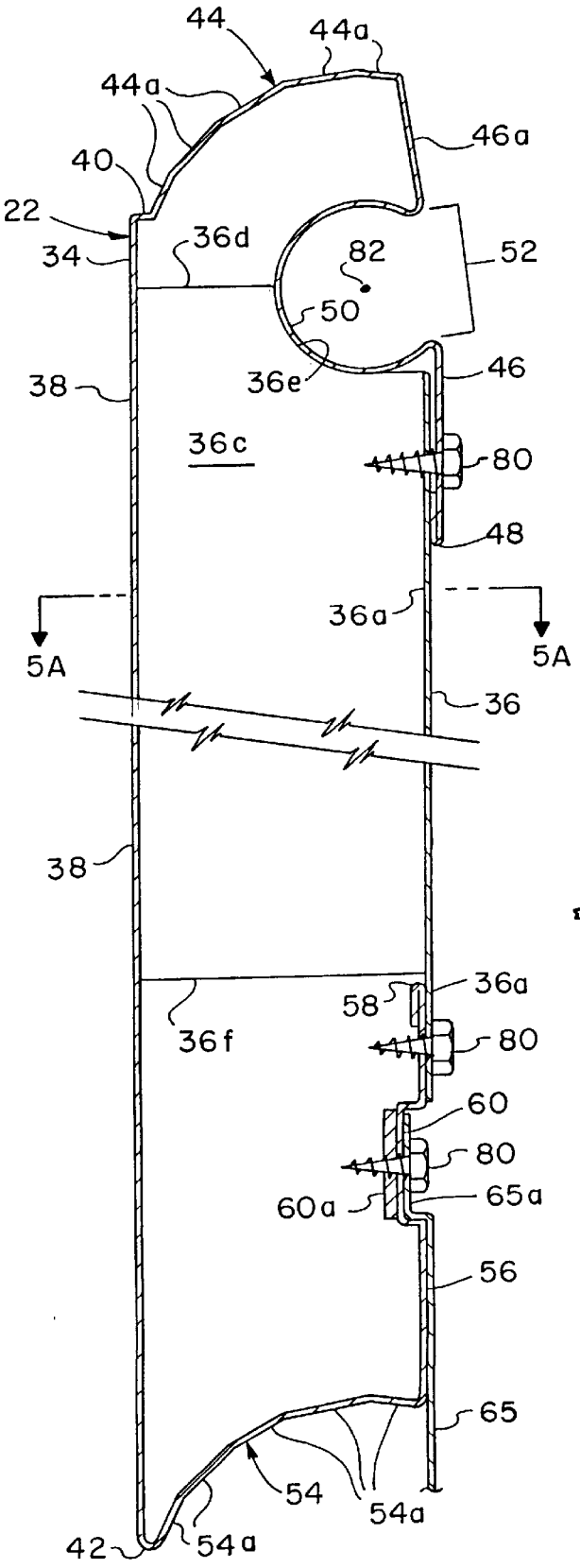
FIG. 5 is a section view taken from the same line as FIG. 4 and illustrating details of the door panel or skin configuration and a reinforcing stile.

Referring briefly to FIG. 5 also, each panel 34 includes a front or outer side wall 38 which extends between an upper generally transverse edge 40 and a lower generally transverse edge 42. Each panel 34 also includes a convex, generally arcuate top wall 44 extending between the edge 40 and an inner side wall 46 generally parallel to the outer wall 38 and depending to a distal edge 48. The upper inner side wall 46 is formed to define a cylindrical socket 50 which is delimited by a gap 52 opening toward the inside surface of the panel 34. The panel 34 is also provided with a concave, substantially arcuate bottom wall 54 extending from the edge 42 to a lower inner side wall 56 which extends generally parallel to outer wall 38 upwardly to a distal edge 58. The lower inner side wall 56 is formed to include a generally rectangular elongated channel 60 extending inwardly from the plane of the side wall 56 toward the outer side wall 38. The arcuate top wall 44, the arcuate bottom wall 54, the socket 50 and the channel 60 extend between opposed side edges 35 and 37 of each panel 34, see FIG. 2. Adjacent sections 22 are interconnected by a hinge assembly 62, FIGS. 4 and 4A, which will be described in further detail herein. For ease of fabrication and to add rigidity, the walls 44 and 54 may be formed of a series of planar surfaces 44*a* and 54*a*, FIG. 5, approximating a continuous arcuate surface.

Figure 3A:
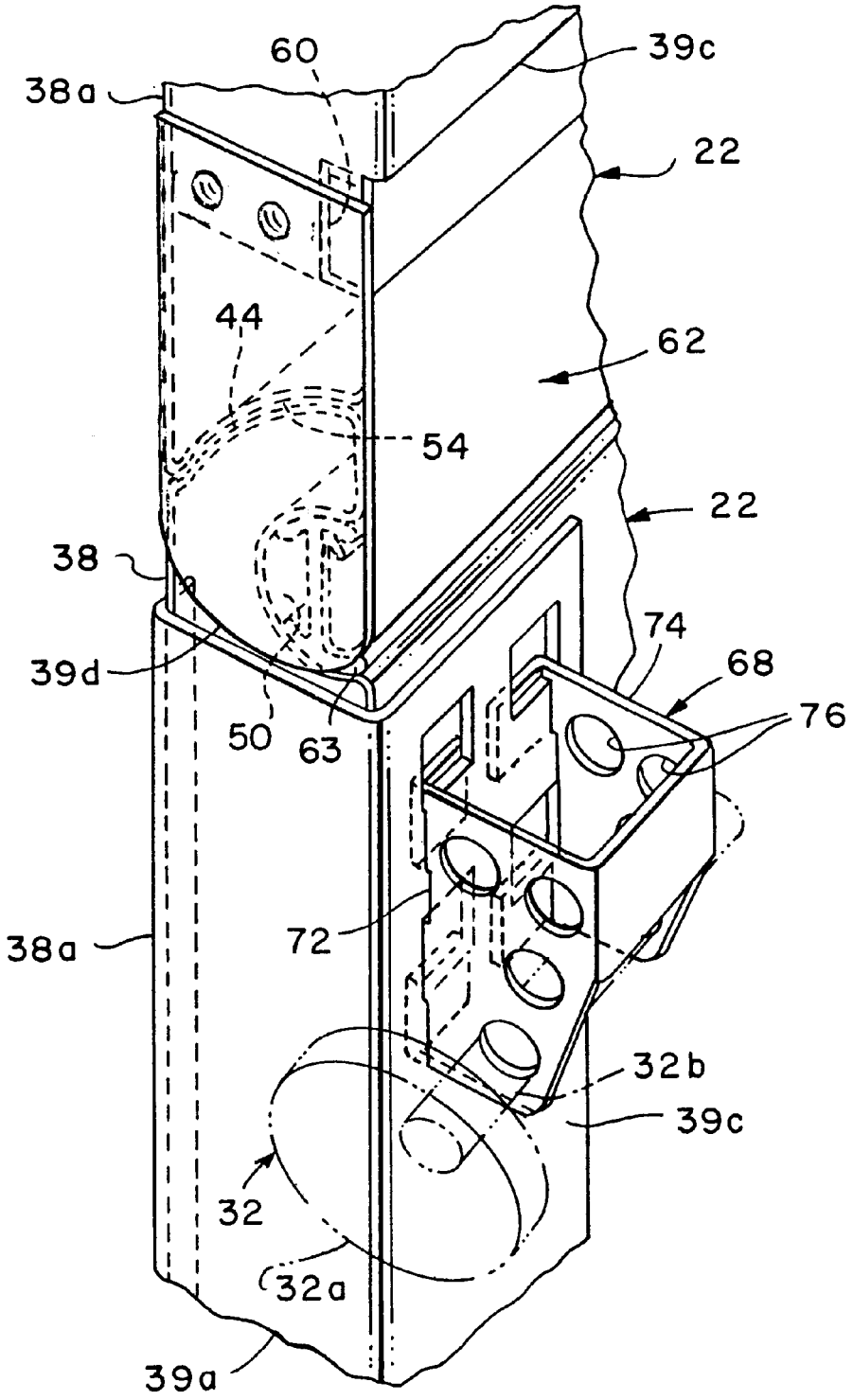
FIGS. 3A and 3B are detail perspective views of two interconnected panels of the door of FIG. 1 showing portions of the panel end stiles.
Figure 3B:
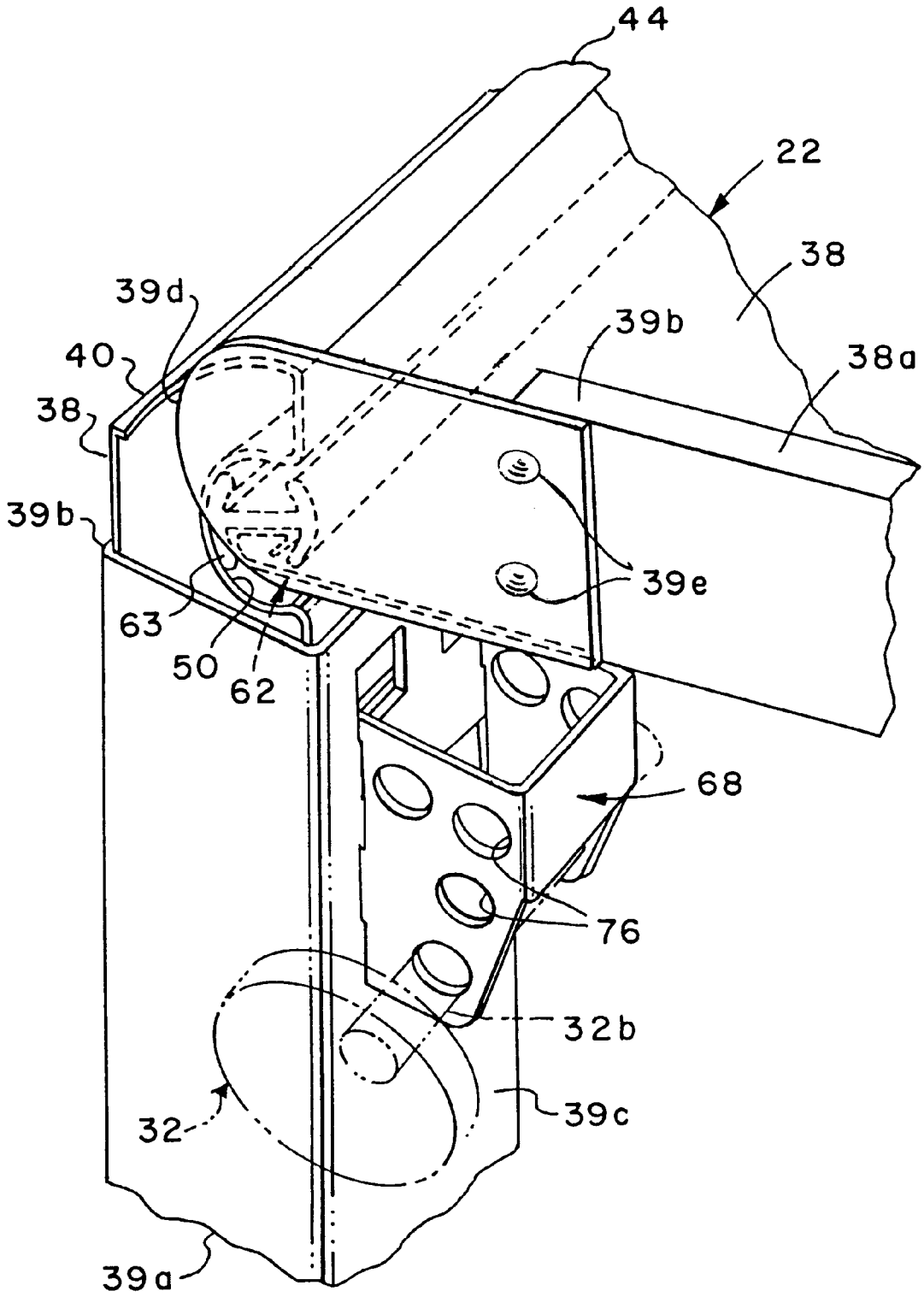

Referring briefly to FIGS. 2, 3A and 3B, each end stile 38*a* comprises a generally channel shaped member having a web portion 39*a* and opposed, generally parallel flanges 39*b* and 39*c*. Flange 39*b* is considerably shorter in width than flange 39*c* and is engageable with the outer or front wall 38 of the panel 34. The linear distance between the flanges 39*b* and 39*c* is only slightly greater than the linear distance between the front wall 38 and the upper and lower inside walls 46 and 56 so that the panel 34 fits within the channel shaped space formed by the end stile 38*a*. The end stiles 38*a* for each panel 34 extend generally between a point just below the socket 50 to a point just above the bottom wall 54. As shown in FIGS. 2, 3A and 3B, a detachable cover 39*d* is adapted to be suitably connected to the end stile 38*a* for covering at least a portion of the hinge connection between adjacent panels, including the space between the top wall 44 and bottom wall 54 of adjacent panels, as these walls move toward each other, when the panels are moving to a door closed position. The covers 39*d* may be provided with suitable means to attach the covers to the end stiles 38*a*, such as spaced apart bosses 39*e*, FIG. 3B, which may be force fitted into cooperating holes 39*f*, see FIG. 3C, formed in the web 39*a* of the end stile.

Figure 3C:
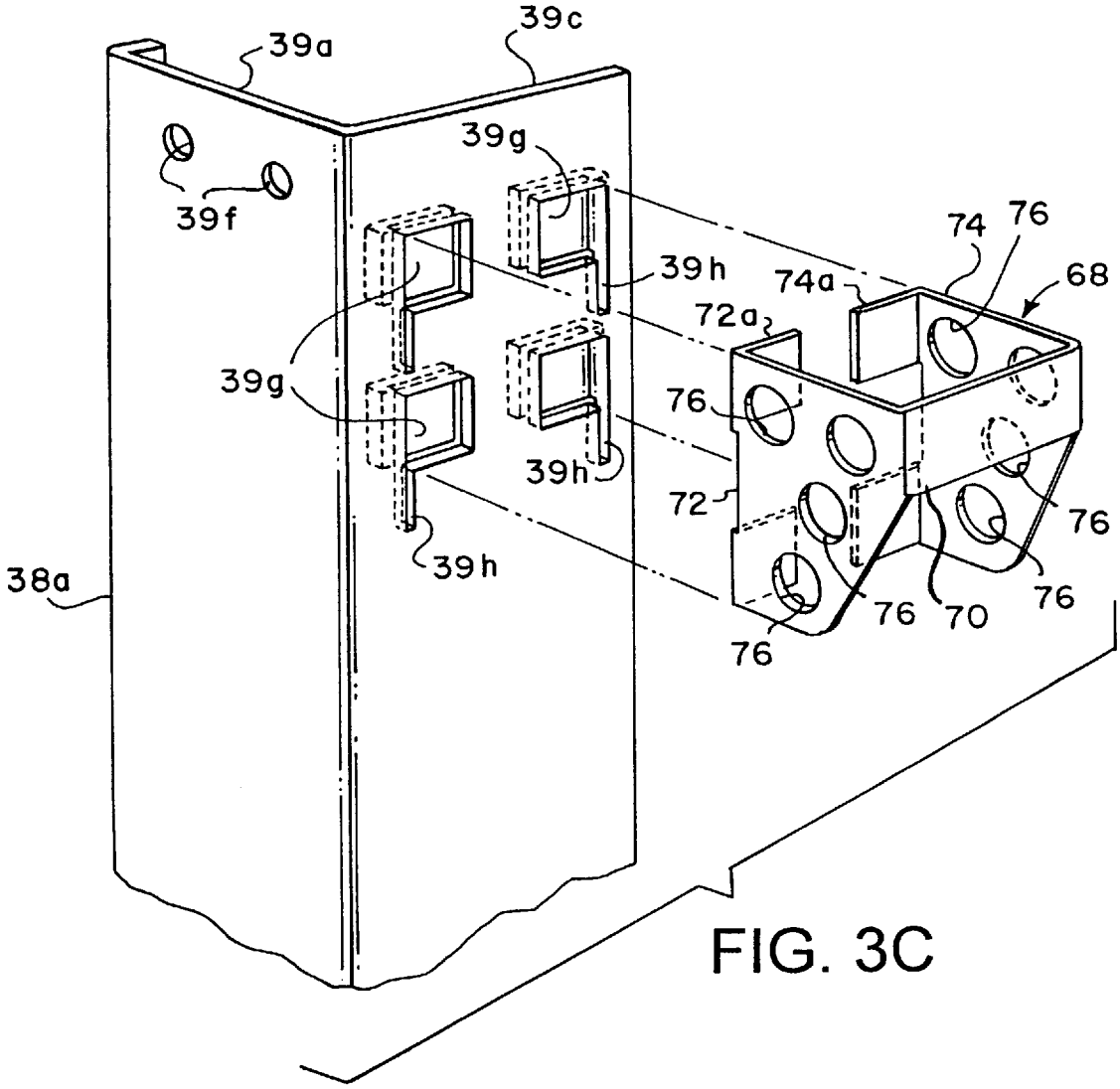
FIG. 3C is a perspective view showing an improved mounting bracket for the door section side edge guide rollers.

Referring further to FIGS. 3A and 3C, the upper and lower edges of the inner flange 39*c* for each end stile 38*a* is provided with suitable means for supporting a guide member support and retainer 68 on the end stile. The guide member retainer 68 comprises a somewhat channel-shaped bracket having a base or web part 70 and opposed flanges 72 and 74, the distal ends of which are provided with spaced apart inwardly turned support feet 72*a* and 74*a*, as shown in FIG. 3C. The flanges 72 and 74 are also provided with spaced apart circular holes 76, respectively, wherein respective pairs of the holes are disposed at various distances from the surface of flange 39*c* when the bracket or retainer 68 is mounted thereon. In this way, guide members 32 may be supported by the guide member retainers 68 at selected positions with respect to the plane of the front wall 38 of the door panel 34 so that the door 20 may be adjusted in its closed position to be properly disposed with respect to the wall 26. This arrangement of the guide members 32 and the guide tracks 28 and 30, the vertical legs of which angle away from the wall 26, is well known to those skilled in the art.

Referring further to FIG. 3C, in particular, the end stile 38*a* is provided with a set of displaced portions of the flange 39*c* forming coined or embossed tabs 39*g*. The tabs 39*g* may be formed by an embossing, coining, or punching operation on the flange 39*c*. Vertically extending slots 39h depend from each of the inwardly displaced tabs 39*g* so that the feet 72*a* and 74*a* may be inserted into the spaces provided by the displaced tabs and slid downwardly whereupon flanges 72 and 74 are disposed in the slots 39*h* and the guide member retainers 68 may be suitably supported on the end stiles 38*a* in the manner shown in FIG. 3A. The retainers 68 may be suitably forcibly retained in engagement with the flanges 39*c* by a suitable adhesive or by mechanical fasteners engaging the feet 72*a* and 74*a* and the flange 39*c*, if desired.

As shown in FIG. 3A, a conventional guide member 32, comprising a roller 32*a* and a generally cylindrical support shaft 32*b*, is adapted to be supported on the retainer 68 in a selected one of opposed pairs of the holes 76 to provide proper orientation of the guide member with respect to the door section, which each pair of guide members supports and guides for movement between open and closed positions of the door. Each guide member shaft 32*b* may be retained in assembly with its retainer 68 by a conventional retaining pin or ring engaged with the shaft in a conventional manner, not shown in the drawings hereof.

Figure 5A:
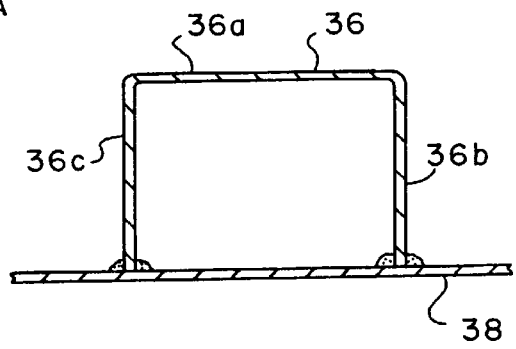
FIG. 5A is a detail section view taken from the line 5A—5A of FIG. 5.

Referring again briefly to FIG. 2, the exemplary door 20 is provided with three spaced apart intermediate stiles 36 which are preferably placed equally spaced apart and, preferably, directly adjacent a bearing member 63 of hinge assembly 62. Depending on the width of a door in accordance with the invention, the number of stiles 36 and bearing members 63 may vary. Referring again to FIGS. 5 and 5A, each of the stiles 36 is characterized as a channel shaped member having a web 36*a* and opposed spaced apart flanges 36*b* and 36*c*. In a preferred configuration of a stile 36, the upper transverse edges 36*d* of the stile flanges 36*b* and 36*c* are provided with an arcuate relieved surface 36*c*, one shown, conforming to the contour of the panel 34 at the cylindrical socket 50 for reinforcing the panel at such socket. Moreover, the upper edges 36*d* of the stile 36 are also disposed between the outer or front wall 38 and the upper inner or inside wall 46, as shown. One of the lower transverse edges 36*f* of the flanges 36*b* and 36*c* is also shown in FIG. 5. As shown, the web 36*a* extends below the edge 36*f* over a portion of the lower inside wall 56, as shown. The overlapping relationship of the inside walls 46 and 56 with respect to the stiles 36 are sufficient to provide for fastening the webs 36*a* of the stiles 36 to the panel 34 with suitable fasteners, for example, self drilling and tapping screws 80, as shown in FIG. 5.

Referring further to FIG. 5, each door section 22 is provided with a hinge pivot axis 82 which also comprises the central axis of the socket 50 and substantially the center of curvature of the convex arcuate top wall 44. Still further, the axis 82 is preferably substantially the axis or center of curvature of the concave arcuate bottom wall 54 of an adjacent section 22 when assembled by a hinge assembly 62. FIG. 5 also illustrates that an upper wall portion 46*a* of inside wall 46 extends in a plane which intersects the plane of the coplanar walls 46 and 56 and extends toward the plane of the front wall 38 from the point of intersection with the socket 50 to the point of intersection with the convex arcuate top wall 44. Thus, the portion 46*a* of the inside wall 46 provides some clearance for the upper portion of the door section 22 with respect to the hinge assembly 62 under certain positional conditions.

Figure 6:
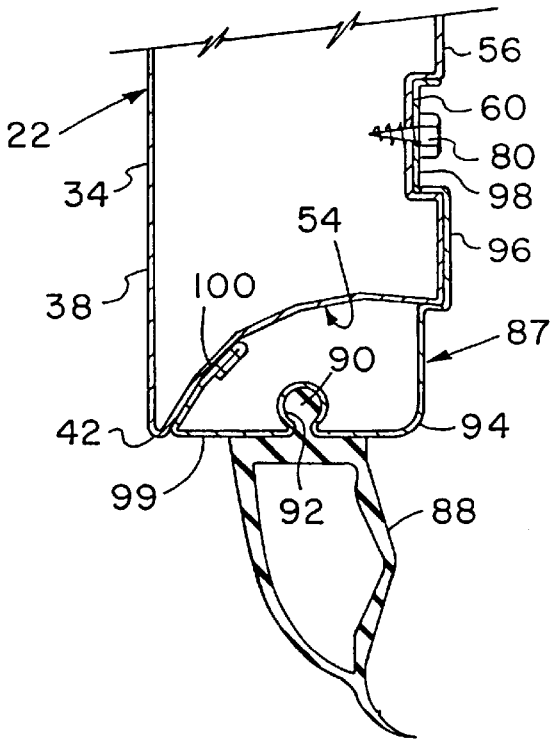
FIG. 6 is a detail section view taken from line 6—6 of FIG. 2.

Referring to FIG. 6, the lowermost section 22 of the door 20 is provided with a weather seal and retainer assembly 87 connected to the bottom wall 54. As shown in FIG. 6, an elongated elastomeric weather seal 88 includes a continuous retainer portion 90 which fits within a cooperating recess 92 of an elongated formed metal seal retainer and support member 94. The retainer and support member 94 includes an upstanding flange 96 having a distal end 98 which fits within the channel 60 of the panel 34 and is secured thereto by suitable spaced apart fasteners 80, for example, one shown in FIG. 6.

The seal retainer member 94 includes a transverse bottom wall 99 engaged with the weather seal 88, as illustrated, and which is folded over to have a distal end portion 100 conforming substantially in cross-sectional shape to the curvature of the bottom wall 54. Accordingly, the door 20 does not require special top and bottom sections or panels and may be made up entirely of sections 22 which may serve as top and bottom sections as well as intermediate sections.

Figure 7:
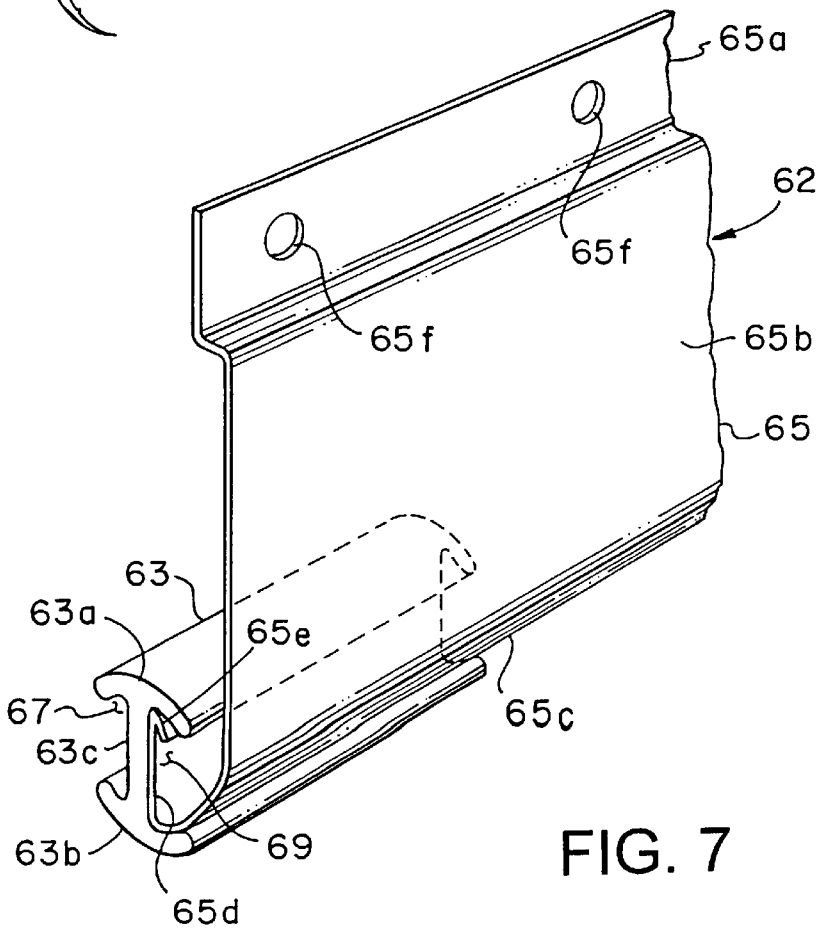
FIG. 7 is a perspective view showing one of the hinge plate bearing members and its assembly to a continuous hinge plate member.

Referring now to FIGS. 4, 4A and 7, each hinge assembly 62 includes an elongated formed plate member 65 having an upper elongated offset portion 65*a*, FIG. 4A, which is dimensioned to fit within the channel 60 of the panel 34. A generally planar section 65*b* depends from the offset portion 65*a* and, at its lower edge is delimited by an arcuate portion 65*c* which is folded in such a way as to form a generally planar portion 65*d* extending in a plane generally parallel to the plane of the portion 65*b*. The planar portion 65*d* terminates at a folded distal flange 65*e*. Each hinge bearing member 63 is characterized by opposed convex curved bearing portions 63*a* and 63*b* interconnected by an elongated web portion 63*c*, see FIG. 7. Thus, the bearing portions 63*a* and 63*b* have opposed cantilever areas extending on each side of the web 63 and forming opposed channel shaped recesses 67 and 69.

The bearing member 63 is preferably formed of a suitable elastomer or polymer material, such as polypropylene, which may be impregnated with a suitable lubricant. A part of the arcuate portion 65*c*, the web 65*d* and the flange 65*e* of hinge member 65 are dimensioned to fit snugly and forcibly within the recess 69 of each hinge bearing member 63. The hinge bearing members 63 may also be suitably secured to the plate members 65 by mechanical fasteners 65*h*, see FIG. 7A. The hinge plate member 65 extends continuously from one side edge 35 to the other side edge 37 of a door section 22, see FIG. 2. However, the bearing members 63 are not continuous, preferably, over the entire width of the door section but are of suitable length (about 2.0 inches to 6.0 inches) and are preferably positioned aligned with and between the stiles 36 of one door section 22 and the stiles 36 of an adjacent door section 22, as shown in FIG. 2. Bearing members 63 are also positioned aligned with and between the opposed end stiles 38*a* of adjacent door sections 22. Thanks to the configuration of the hinge bearing members 63 and the stiles 36 forces acting between door sections 22 due to the weight of the door 20 in the closed position, for example, are transferred through the stiles 36 and 38*a* and the hinge bearing members 63 to minimize any tendency for the door panels 34 to buckle.

Figure 7A:
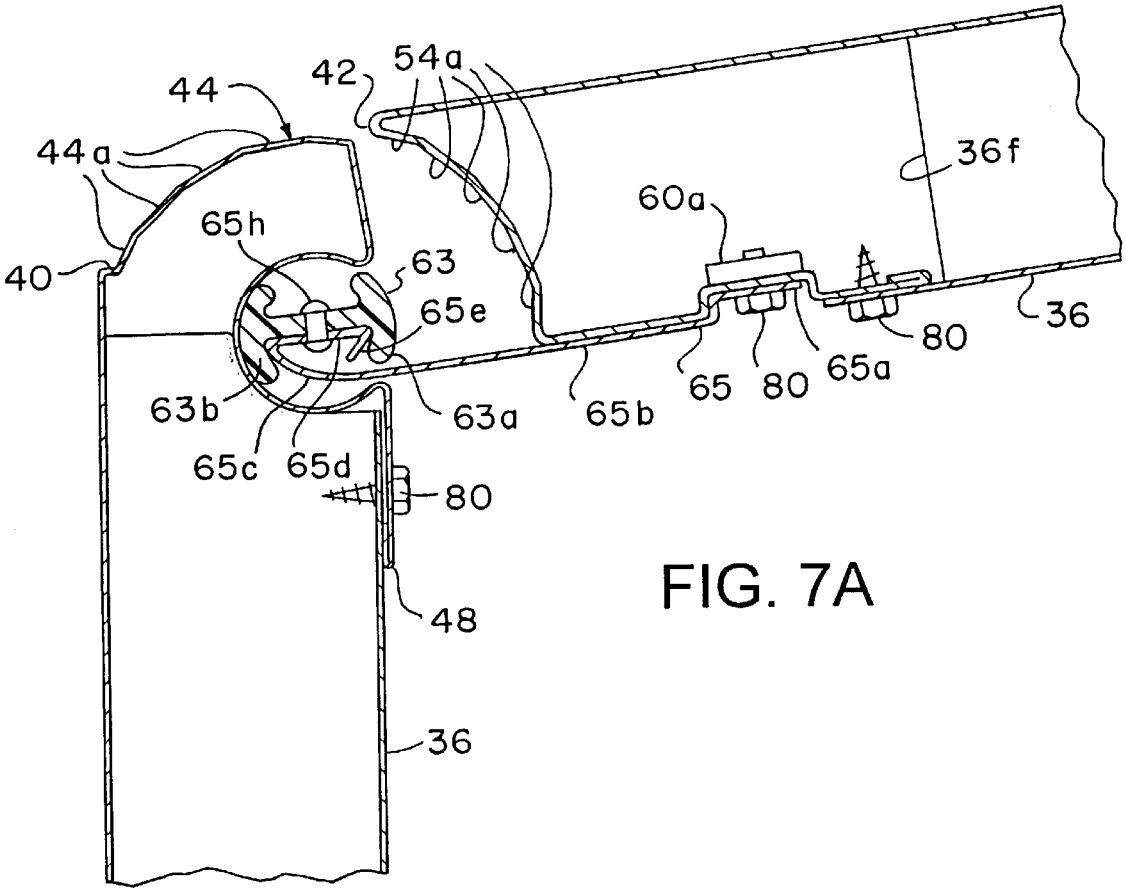
FIG. 7A is a detail section view illustrating assembly or disassembly of the hinge connection between adjacent door sections.

Referring further to FIGS. 7 and 7A, the hinge plate member 65 is suitably secured to the lower inside wall 56 of a panel 34 by spaced apart self drilling threaded fasteners 80, for example. The offset plate portion 65*a* may be provided with spaced apart preformed fastener receiving holes 65*f*, FIG. 7. The inside bottom portion of the channel 60 may be supported by and suitably secured to a reinforcing plate 60*a*, as shown in FIG. 5, for receiving the fasteners 80 for suitably retaining the fasteners in assembly with the panel 34.

As shown in FIG. 7A, the circumferential arc of the bearing portions 63*a* and 63*b* of the bearing member 63 are defined such that the gap 52 will permit insertion of the bearing member laterally into the socket 50 upon assembly of one door section 22 to another door section. The width of the gap 52 and the circumferential arc of the bearing portions 63*a* and 63*b* are also chosen such that during normal operation of the door 20, the sections 22 do not rotate relative to each other sufficiently to permit disengagement of the bearing members 63 from the socket 50. However, during assembly and disassembly, the sections 22 are rotated relative to each other sufficiently to allow lateral insertion and removal of the bearing members 63 with respect to the socket 50 of the adjacent door section. Typically, each section 22 may be shipped from the point of manufacture to the point of assembly with the hinge assembly 62 secured to the bottom edge of a section, although this is not necessary. The hinge assemblies 62 may be secured to each section 22 at the point of assembly and just prior to assembling the door sections to each other.

Those skilled in the art will also appreciate from the foregoing description, read in conjunction with the drawings, that the door 20 has a particularly advantageous pinch resistant construction. As shown in FIG. 4A, when the door 20 is moved between the closed position and any other position during normal operation of the door, the cooperating top and bottom walls 44 and 54 move adjacent to but closely spaced from each other to prevent insertion of a person's finger between the door sections. The lower edge 42 of one section 22 does not normally move beyond the intersection of the top wall 44 with the inner side wall portion 46*a* of the adjacent section 22 in the maximum rotated position of one door section relative to the other when the door is supported in the guide tracks 28 and 30. Moreover, by providing the continuous hinge member 65 extending from one side edge 35 of a panel 34 to the other edge 37, there is no point of entry of a person's finger from the inside of the door 20 which could result in a pinching action as the door sections 22 move relative to each other. The hinge plate member 65 adds strength to each door section while the spaced apart bearing members 63 provide a low friction hinge connection between each door section which is also quiet in operation.

Figure 8:
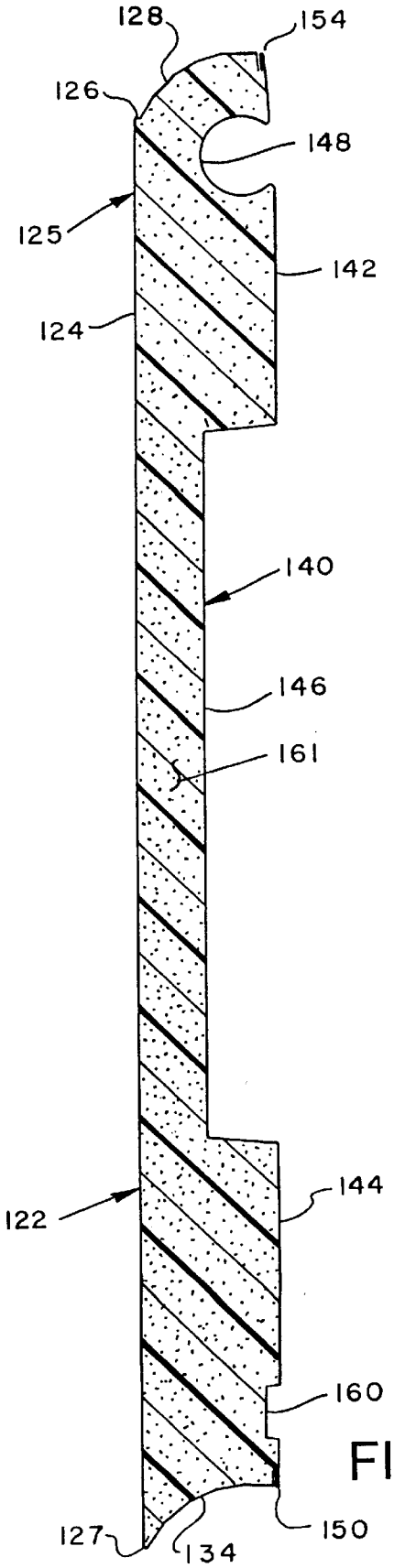
FIG. 8 is a transverse section view of a door section including separate front and back skins and an insulation layer therebetween.
Figure 9:
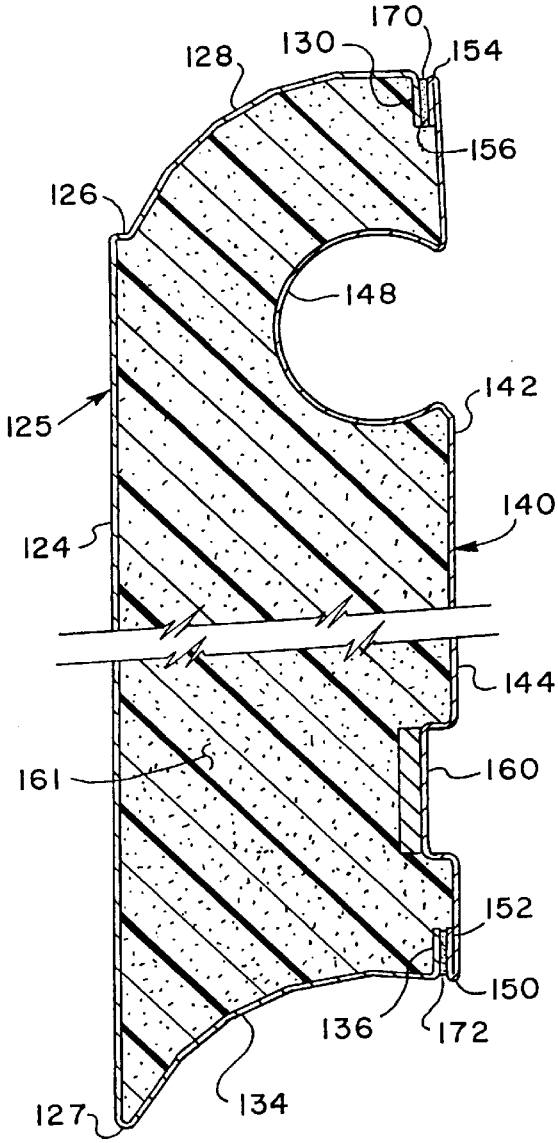
FIG. 9 is a detail section view similar to FIG. 8 on a larger scale.

Referring now to FIGS. 8 and 9, there is illustrated an embodiment of a door section in accordance with the invention which is adapted to provide certain thermal insulating characteristics when used in a sectional door such as the door 20. The door 20, for example, may be made up of plural interconnected door sections, such as the door section 122, having a generally planar front wall 124 formed by an outer or outside foldable metal skin panel member 125. The panel member 125 includes an upper transverse edge 126 and a top wall 128 which is similar to the top wall 44 and has an arcuate convex curvature. The wall 128 terminates at a downwardly folded edge 130 of the panel member 125, see FIG. 9, which may be reinforced by folding the edge of the panel skin back onto itself, not shown. The panel member 125 also includes a lower transverse edge 127 at an intersection between the front wall 124 and a concave arcuate bottom wall 134. The bottom wall 134 terminates at an upwardly turned distal end 136 which may also be reinforced by folding the metal skin of the panel back onto itself, if desired, but not shown.

The door section 122 also includes an inner or inside panel member 140 which may be formed of a folded metal skin having coplanar wall portions 142 and 144 contiguous with an intermediate recessed wall portion 146. The depth of the recess formed by the wall portion 146 may be varied in accordance with the insulating requirements of a door made up of sections 122. In fact, the inner skin or panel member 140 may be coplanar over its entire extent between an arcuate socket portion 148, corresponding to the socket 50 of section 22, and a lower transverse edge 150. Lower edge 150 is reinforced by folding the metal of the inner panel 140 back on itself at 152.

The panel 140 terminates at an upper edge 154 wherein the material of the panel 140 is also folded back onto itself at the folded edge 156. The folded edges 130 and 156 are substantially coextensive as are the folded edges 136 and 152 across the lower edge of the door section 122. Accordingly, the door section 122 is constructed to have a hinge receiving socket 148 and a channel 160 which correspond to the socket 50 and the channel 60 of a door section 22. However, the construction of the section 122 is such as to allow filling substantially the entire space between the front and back panels 125 and 140 with an insulating material 161, FIG. 8, such as polyurethane foam, for example.

The front or outside panel member 125 is secured to the rear or inside panel member 140 at cooperating elongated strips of low thermal conductivity material or so-called thermal breaks 170 and 172. The material making up the thermal break members 170 and 172 may comprise an adhesive of sufficient thickness to prevent contact between the surfaces of the edges 130 and 156 or between the surfaces of the edges 136 and 152.

When the door sections 22 or 122 are assembled to each other by the hinge assemblies 62 and are disposed in a closed position of the door, the cooperating pinch resistant arcuate surfaces 44 and 54 of adjacent panels 22 and the cooperating arcuate surfaces 128 and 134 of adjacent panels 122 do not forcibly contact each other. Typically, there is a small gap between the surfaces or, if desired, the surfaces are dimensioned such that the edges 126 and 127 of adjacent panels 122 or the edges 40 and 42 of adjacent panels 22 may contact each other. If the upper and lower outside edges of adjacent panels do not contact each other and there is still a small gap between the pinch resistant profile surfaces, a substantial light and weather seal is still provided for a door made up of sections 22 or 122 by the provision of the hinge assembly 62 with the continuous hinge plate member 65 which extends between the side edges of the door.

Figure 10:
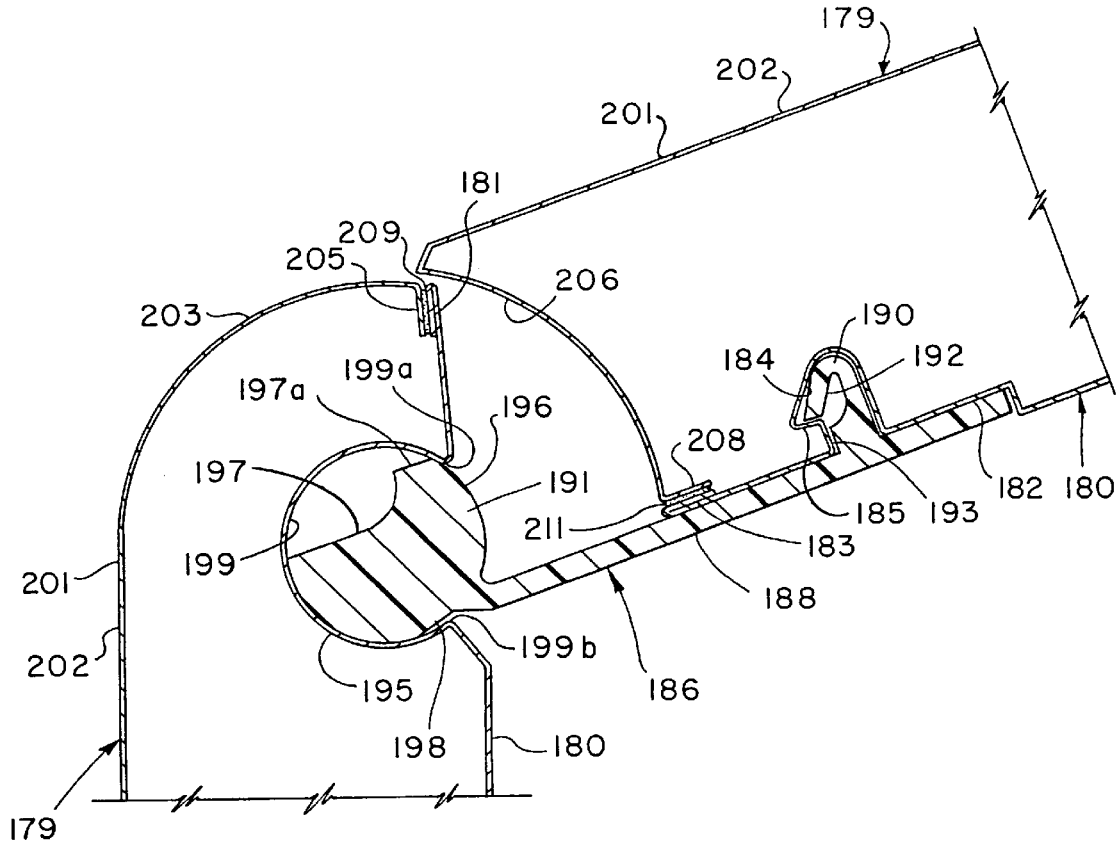
FIG. 10 is a transverse section view of an alternate embodiment of a continuous hinge and pinch resistant panel edge profile for interconnected door sections in accordance with the invention.

Referring now to FIG. 10, there is illustrated an embodiment of a sectional door in accordance with the invention which may utilize interconnected sections 179 substantially similar to the sections 122 but wherein each section is modified, as shown, to include an inside panel member 180 which is folded to provide a recess 182 including a portion 184 with a re-entrant edge 185 for retaining a hinge member 186 in assembly with the section. In the embodiment of FIG. 10, the hinge member 186 comprises a continuous integral hinge member extending substantially the entire width of the door. The hinge member 186 comprises a generally flat plate part 188 including an integral, somewhat dart-shaped retainer part 190 with a flexible distal finger portion 192 which may be inserted in a gap 193 within the recess 184 and engage the re-entrant edge 185 to retain the hinge member in assembly with the lower edge of a door section.

The hinge member 186 also includes a continuous partial cylindrical hinge pin 191 having arcuate cylindrical bearing surfaces 195 and 196 intersected by a discontinuous surface 197, 197*a* and a second surface 198 spaced therefrom and adjacent an integral connection between the hinge pin 191 and the hinge plate member 188. The hinge 186 is configured such that the distance between surfaces 197*a* and 198 is less than the gap between socket edges 199*a* and 199*b* to provide for lateral insertion of the pin 191 in a socket 199 in the same manner as the hinge assembly 62 is inserted in the socket 50 or 148. During normal rotation of one door section 179 with respect to an adjacent and connected door section, as shown in FIG. 10, the surfaces 197*a* and 198 do not register with the gap in the socket 199 to permit disconnection of the door sections. However, on assembly, a door section 179 to which a hinge member 186 is connected is rotated an additional extent, clockwise, viewing FIG. 10, to permit insertion and removal of the hinge pin 191 with respect to the socket 199. The door sections 179 also include a front panel member 201 which may be fabricated to form a door section having a configuration similar to the section 122 including a continuous convex arcuate top wall 203 which is folded over at a distal edge 205. The panel 201, which has an outer or front wall 202, is also provided with an arcuate concave, continuous bottom wall 206 folded over at a distal edge 208. As shown in FIG. 10, the inside panel member 180 is folded over at opposite parallel edges 181 and 183, respectively, and suitably secured to the front panel member 201 by an adhesive layer 209 and 211, as shown, to secure the panels together. The panel 179 may be insulated or uninsulated and provided with reinforcing stiles, not shown, if desired.

The hinge member 186 may be fabricated of extruded plastic or the like or otherwise cast or molded as a continuous one-piece member and a door made up of sections 179 interconnected by hinges 186 enjoys substantially all of the advantages of doors made up of sections 22 or 122 and hinge assemblies 62, respectively.

The construction and operation of a sectional door and hinge assembly as described above and in accordance with the invention is believed to be within the purview of one of skill in the art of sectional doors and hinges therefor.

Materials used for fabricating the door 20 utilizing door sections 22, 122 and hinges 62 or 186 may be selected from those which are known to those skilled in the art. Although preferred embodiments of a sectional door have been described in detail herein, those skilled in the art will also recognize that various substitutions and modifications may be made without departing from the scope and spirit of the invention as recited in the appended claims.

What is claimed is:

1. In a sectional door for forming a closure over a door opening, a plurality of door sections hingedly connected to each other for movement between open and closed positions of said door, said sections each including a panel forming a generally planar outer wall, a generally planar inner wall spaced from said outer wall, a convex curved top wall of said panel extending between said outer wall and said inner wall and a concave curved bottom wall extending between said outer wall and said inner wall of said panel, said sections being movable relative to each other between open and closed positions of said door wherein said convex and concave curved walls of adjacent sections move relative to each other without allowing a pinching action, said sections each having a portion of said inner wall forming a socket and a gap in said inner wall and opening into said socket; and a hinge assembly for interconnecting adjacent sections to each other for movement of said sections relative to each other between open and closed positions of said door, said hinge assembly including an elongated plate member secured to one of said sections and extending across a gap formed between adjacent sections, said plate member being connected to plural spaced apart hinge bearing members disposed in said socket of an adjacent section and engaged with said adjacent section at said socket to form a hinge connection between said adjacent sections, said hinge bearing members each including arcuate bearing portions having a width less than the width of said gap and providing for lateral assembly and disassembly of said adjacent sections with respect to each other by moving said hinge baring members into and out of said socket through said gap, said arcuate bearing portions being spaced from each other to retain said hinge bearing members in said socket.

2. The door set forth in claim 1 wherein:

said hinge bearing members are formed of a self-lubricating polymer.

3. The door set forth in claim 1 wherein:

said hinge bearing members and said plate member are integrally joined.

4. The door set forth in claim 1 wherein:

said plate member includes a portion in engagement with said hinge bearing members between said arcuate bearing portions of said hinge bearing members.

5. The door set forth in claim 1 wherein:

said plate member extends substantially across the width of said door from one lateral edge to an opposite lateral edge of said adjacent sections.

6. The door set forth in claim 1 wherein:

each of said sections includes at least one reinforcing member extending between a top wall of said section and a bottom wall of said section and aligned with a hinge bearing member for transferring forces between adjacent ones of said sections by way of said reinforcing members and said hinge bearing members.

7. The door set forth in claim 1 wherein:

said panel comprises a formed sheet including said outer wall, said top wall and said bottom wall.

8. The door set forth in claim 7 wherein:

said sheet is formed to provide said inner wall.

9. The door set forth in claim 7 wherein:

said sections each include a first panel forming said outer wall, said top wall and said bottom wall and a second panel forming said inner wall, said panels being secured together to form said section.

10. The door set forth in claim 9 wherein:

a space between said panels is filled with an insulating material.

11. A door section for a door made up of a plurality of hingedly interconnected ones of said sections to form a closure over an opening, said section comprising:

a panel including a generally planar outer wall, a top wall, a bottom wall, an upper inner wall spaced from said outer wall and a lower inner wall spaced from said outer wall, one of said upper and lower inner walls including a portion forming a generally cylindrical socket for receiving a hinge bearing member, said socket being coextensive with the overall width of said section, said socket being delimited by a gap formed in said one inner wall for receiving said hinge bearing member whereby said section may be interconnected to an adjacent section by a hinge assembly; and at least one stile member extending between said upper inner wall and said lower inner wall and including a portion at opposite ends, respectively, for securing said stile member to said section, said stile member comprises a channel shaped member having a web and opposed flanges, at least one of said flanges is contiguous with said portion of said wall forming said socket at one end of said stile member, and said web is secured to said inner wall at the opposite end of said stile member for transferring forces exerted on said section from one section to another through hinge assemblies connecting adjacent sections to each other.

12. The door section set forth in claim 11 wherein:

said top wall comprises a convex curved portion extending substantially between said outer wall and said upper inner wall.

13. The door section set forth in claim 11 wherein:

said bottom wall comprises a generally concave curved portion extending substantially between said outer wall and said lower inner wall.

14. The door section set forth in claim 11 wherein:

said upper inner wall includes a portion extending in a plane which intersects a plane extending substantially parallel to the plane of said outer wall between said gap and said top wall.

15. The door section set forth in claim 11 wherein:

said lower inner wall includes a recess therein for receiving a hinge plate member connected to said hinge bearing member.

16. The door section set forth in claim 11 wherein:

a plurality of said stile members are secured to said door section between opposite side edges thereof.

17. The door section set forth in claim 11 including:

opposed end stile members secured to said door section at opposite side edges thereof, respectively.

18. The door section set forth in claim 17 wherein:

each of said end stile members includes a channel shaped portion defined by a web and opposed, generally parallel flanges connected to said web.

19. The door section set forth in claim 17 wherein:

said end stile members include a web portion extending over said socket of an adjacent door section to which said one door section is connected.

20. The door section set forth in claim 11 wherein:

said outer wall, said top wall and said bottom wall are integrally joined as a first panel member.

21. The door section set forth in claim 20 wherein:

said upper inner wall and said lower inner wall are integrally joined to said top wall and said bottom wall, respectively.

22. The door section set forth in claim 20 wherein:

said upper inner wall and said lower inner wall are formed on a second panel member and secured to said first panel member at spaced apart edges of said panel members, respectively.

23. The door section set forth in claim 11 including:

thermal insulation material disposed between said outer and inner walls.

24. In a sectional door for forming a closure over a door opening, a plurality of door sections hingedly connected to each other for movement between open and closed positions of said door, said sections each including a panel forming generally planar outer and inner wall surfaces, said sections each having a portion forming a socket delimited by a gap opening to said inner wall surface; and a hinge assembly for interconnecting adjacent sections to each other for movement of said sections relative to each other between open and closed positions of said door, said hinge assembly including an elongated plate member secured to one of said sections of a pair of adjacent sections and extending across a gap formed between said adjacent sections, said plate member being connected to plural spaced apart hinge bearing members disposed in said socket of an adjacent section to form a hinge connection between said adjacent sections and for movement of said adjacent sections between open and closed positions of said door, said hinge bearing members each include opposed arcuate bearing portions having a width less than the width of said gap which delimits said socket to provide for lateral assembly and disassembly of said adjacent sections with respect to each other, said opposed arcuate bearing portions are spaced from each other a distance sufficient to retain said hinge bearing members in said socket, respectively.

25. The door set forth in claim 24 wherein:

said plate member extends substantially across the width of said door from one lateral edge to an opposite lateral edge of said adjacent sections.

26. The door set forth in claim 24 wherein:

said plate member includes a portion which is in engagement with said hinge bearing members between said opposed arcuate bearing portions of said hinge bearing members, respectively.

27. A door section for a door made up of a plurality of hingedly interconnected ones of said door sections to form a closure over an opening, said door section comprising:

a panel including a generally planar outer wall, a top wall, a bottom wall, an upper inner wall spaced from said outer wall and a lower inner wall spaced from said outer wall, one of said upper and lower inner walls including a portion forming a generally cylindrical socket for receiving a hinge bearing member, said socket being coextensive with the overall width of said section, said socket being delimited by a gap formed in said one inner wall for receiving said hinge bearing member whereby said section may be interconnected to an adjacent section by a hinge assembly including a hinge bearing member insertable laterally in said socket through said gap; and spaced apart guide member support and retainer members supported on said door section adjacent said inner wall, said retainer members each comprising a channel shaped member having a plurality of holes formed in spaced apart flange portions and aligned with each other for receiving a shaft of a guide member for guiding said door section in assembly with a door comprising multiple door sections hingedly connected to each other, said retainer members including spaced apart feet for connecting said retainer member to said door section by registering said feet of said retainer members with spaced apart recesses on said door section and sliding said retainer members into a working position connected to said door section.

28. A door section for a door made up of a plurality of hingedly interconnected ones of said door sections to form a closure over an opening, said door section comprising:

a panel including a generally planar outer wall, a top wall, a bottom wall, an upper inner wall spaced from said outer wall and a lower inner wall spaced from said outer wall, one of said upper and lower inner walls including a portion forming a generally cylindrical socket for receiving a hinge bearing member, said socket being coextensive with the overall width of said door section, said socket being delimited by a gap formed in said one inner wall for receiving said hinge bearing member whereby said door section may be interconnected to an adjacent door section by a hinge assembly including a hinge bearing member insertable laterally in said socket through said gap; and opposed end stile members secured to said door section at opposite side edges thereof, respectively, each of said end stile members includes a channel shaped portion defined by a web and opposed, generally parallel flanges connected to said web and said end stile members include a web portion extending over a socket of an adjacent door section to which said door section is connected.

* * * * *

UNITED STATES PATENT AND TRADEMARK OFFICE

CERTIFICATE OF CORRECTION

PATENT NO. : 6,098,697
DATED : August 8, 2000
INVENTOR(S) : LeRoy G. Krupke, D. Scott Boucher and W. Mark Megarity It is certified that error appears in the above-identified patent and that said Letters Patent is hereby corrected as shown below:

Column 9,
Line 44, after "gap" insert -- in said inner wall --.
Line 46, change "baring" to -- bearing --.

Column 9,
Line 47, after "gap" insert -- in said inner wall --.

Column 11,
Line 45, after "gap" insert -- opening to said inner wall --.

Signed and Sealed this

Sixteenth Day of April, 2002

*Attest:*

*Attesting Officer*

JAMES E. ROGAN
*Director of the United States Patent and Trademark Office*